US006065169A

United States Patent [19]

Cheldin

[11] Patent Number: 6,065,169

[45] Date of Patent: May 23, 2000

[54] COMBINATION LETTER OPENER AND WRITING INSTRUMENT

[76] Inventor: Erwin Cheldin, 23251 Mulholland Dr., Woodland Hills, Calif. 91364-2732

[21] Appl. No.: 09/287,254

[22] Filed: Apr. 7, 1999

[51] Int. Cl.[7] ..... B26B 11/00

[52] U.S. Cl. ..... 7/160; 7/158

[58] Field of Search ..... 7/158, 160, 161, 7/169

[56] References Cited

U.S. PATENT DOCUMENTS

| | | | |
|---|---|---|---|
| D. 352,217 | 11/1994 | Hochfeld et al. . | |
| 844,770 | 2/1907 | Bauer | 7/160 |
| 1,592,203 | 7/1926 | Hammalian | 7/158 |
| 2,356,693 | 8/1944 | Polzer . | |
| 2,400,988 | 5/1946 | Goessel . | |
| 4,028,758 | 6/1977 | O'Connor . | |
| 4,670,926 | 6/1987 | Bruno . | |

*Primary Examiner*—James G. Smith
*Assistant Examiner*—David B. Thomas
*Attorney, Agent, or Firm*—Kelly Bauersfeld Lowry & Kelley, LLP

[57] ABSTRACT

A letter opener is coupled to a body of a writing instrument to form a unique combination. The letter opener includes a frame having a tapered finger protrusion extending therefrom and defining a paper accepting channel which has a cutting element positioned therein. The letter opener may include fasteners for removably attaching the frame of the letter opener to the writing instrument, or the letter opener may be formed integrally with the elongated body of the writing instrument.

5 Claims, 3 Drawing Sheets

COMBINATION LETTER OPENER AND WRITING INSTRUMENT

BACKGROUND OF THE INVENTION

The present invention relates to letter openers. More particularly, the present invention relates to a letter opener which is coupled to a writing instrument, such as a mechanical pencil or an ink pen.

Writing instruments and letter openers are well known and have been in use for many years. There are a variety of writing instruments frequently used in the office and residential settings such as markers, wood pencils, mechanical pencils, ball point pens and retractable ink pens. The basic components of a typical writing instrument include a hollow body support structure, which also acts as a handle, and the writing element which is usually disposed within the hollow body. A writing instrument can include many features such as erasers, pocket clips, retractable mechanisms, and other similar attachments.

There are two general types of manually operated letter openers. The first is an elongated blade having a tapered point and rather dull edges. The blade is usually formed of metal and the tapered point is placed in an opening of the envelope flap and an edge of the blade forced through the paper flap of the envelope to reveal the contents of the envelope. The second type of letter opener is a rounded handle piece, usually comprised of hardened plastic, having a narrow channel formed by the handle piece and a protrusion of the handle. A cutting blade is positioned within the channel. An end of the protrusion is inserted under the flap and the flap is guided through the channel and slit open by the cutting blade to reveal the contents of the envelope.

Letters are typically received in bulk periodically during the day or week. The person opening the letter envelopes, such as a receptionist or secretary, must find a letter opener or have a space reserved for the letter opener so as not to misplace or lose it. At times, the person opening the envelopes may not quickly find the letter opener and resorts instead to using other objects not designed to open letters, possibly resulting in excessive tearing of the envelope or even damage to the contents of the envelope.

Oftentimes while opening the letters, the person may need to use a writing instrument at nearly the same time as opening the letter in order to write notes, catalog the receipt of the letters and their contents, or for a variety of other reasons. This tedious procedure requires putting the letter opener down and picking up the pen repeatedly to take notes while opening and sifting through envelopes, letters and other papers. This has been found to be very inconvenient.

Therefore, what is needed is a letter opener which is attachable to, or otherwise formed with, a writing instrument in order to alleviate the inconveniences of using separate letter openers and writing instruments.

SUMMARY OF THE INVENTION

The present invention resides in the combination of a writing instrument having an elongated body, and a letter opener coupled to the body of the writing instrument. The letter opener includes a frame having an extending finger protrusion which tapers to an end thereof, and a paper accepting channel defined by an inner edge of the frame and finger protrusion. A cutting element is positioned on an inner edge of the paper accepting channel. The cutting element is preferably comprised of a triangular metal razor blade. In use, the finger protrusion is inserted into an opening in the flap of the envelope and acts as a guide to feed the paper flap into the paper accepting channel where it is slit open by the cutting element, revealing the contents of the envelope.

In one form of the invention, the letter opener includes a frame having fasteners for attaching the frame to the writing instrument. These fasteners comprise coupling clips which are integrally formed on the frame of the letter opener. The letter opener is removably attachable to the writing instrument by pressing the body of the writing instrument into the fasteners. In this manner, the letter opener can be positioned at any spot on the writing instrument, and removed from one writing instrument to another.

In another form of the invention, the letter opener is integrally formed with the body of the writing instrument. The space between the extending tapering finger protrusion and the body of the writing instrument forms the paper accepting channel. Although the writing instrument may take any form, a writing instrument having a plastic body such as an ink pen or a mechanical pencil, is preferred.

In yet another form of the invention in which the letter opener is integrally formed with the writing instrument, the elongated body includes a hump which extends towards the finger protrusion and further defines the paper accepting channel.

Other features and advantages of the present invention will become apparent from the following more detailed description, taken in conjunction with the accompanying drawings which illustrate, by way of example, the principles of the invention.

DETAILED DESCRIPTION OF THE PREFERRED EMBODIMENTS

Figure 1:
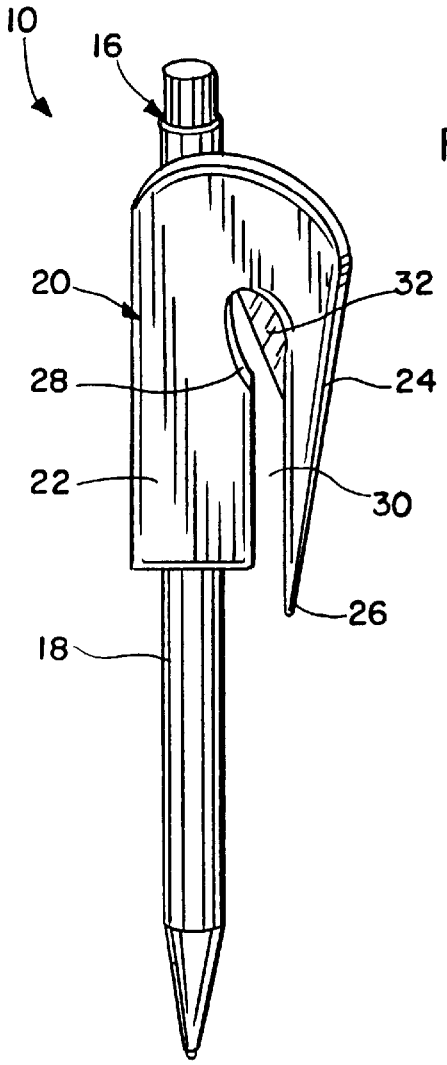
FIG. 1 is a front elevational view of a writing instrument having a clip-on letter opener affixed thereto.
Figure 2:
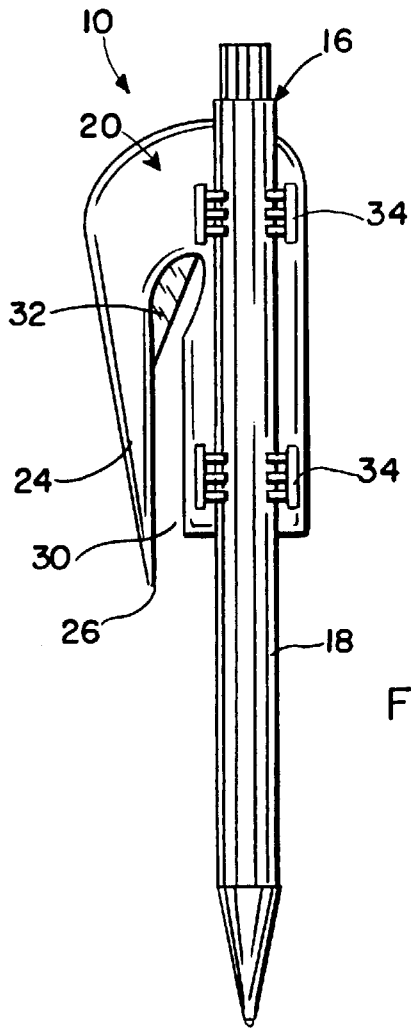
FIG. 2 is a rear elevational view of the combination writing instrument and letter opener of FIG. 1.
Figure 3:
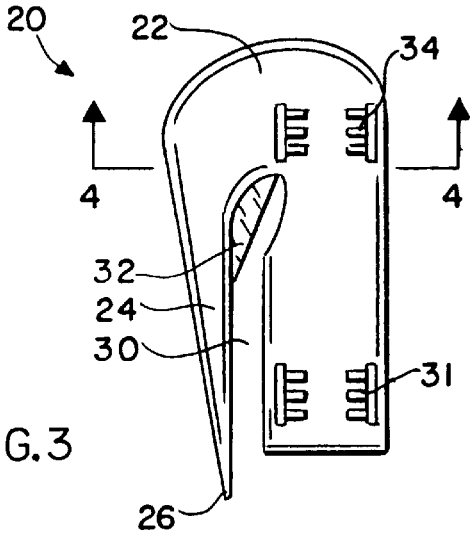
FIG. 3 is a rear elevational view of the clip-on letter opener of FIGS. 1 and 2.
Figure 4:
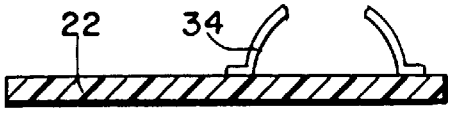
FIG. 4 is an enlarged cross-sectional view taken generally along the line 4—4 of FIG. 3, illustrating writing instrument-engaging fasteners extending from a surface thereof.
Figure 5:
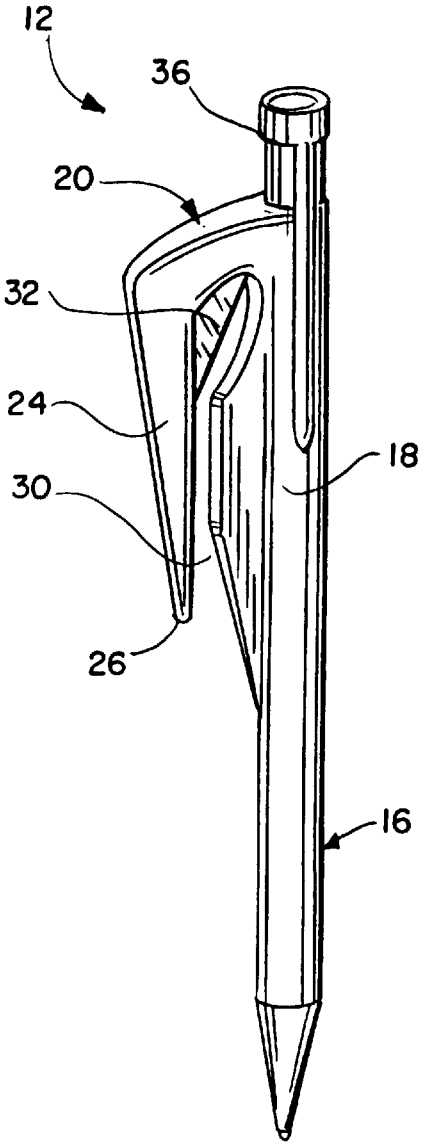
FIG. 5 is a perspective view of a writing instrument having a letter opener integrally formed therewith.
Figure 6:
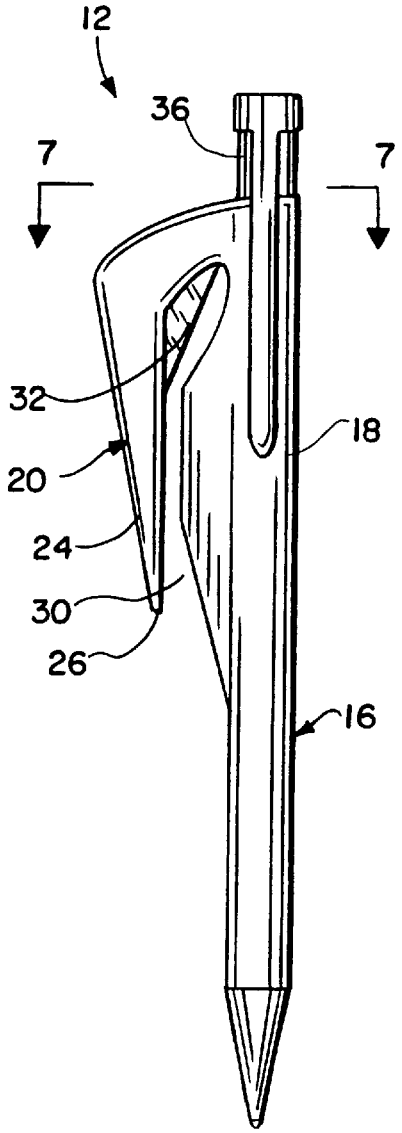
FIG. 6 is an elevational view of the combination writing instrument and letter opener of FIG. 5.
Figure 7:
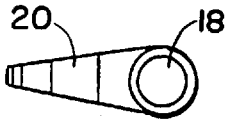
FIG. 7 is a top plan view of the body of the combination writing instrument and letter opener of FIGS. 5 and 6 taken generally along the line 7—7 of FIG. 6.
Figure 8:
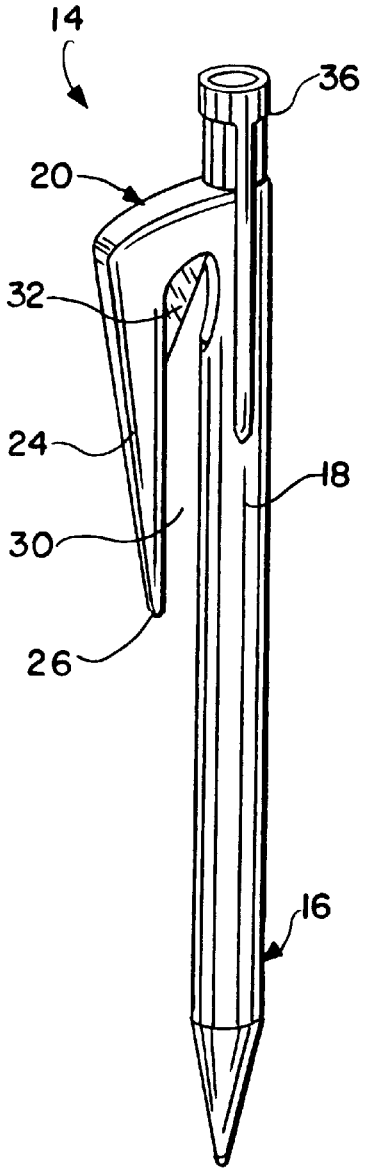
FIG. 8 is a perspective view of yet another writing instrument having a letter opener integrally formed therewith.
Figure 9:
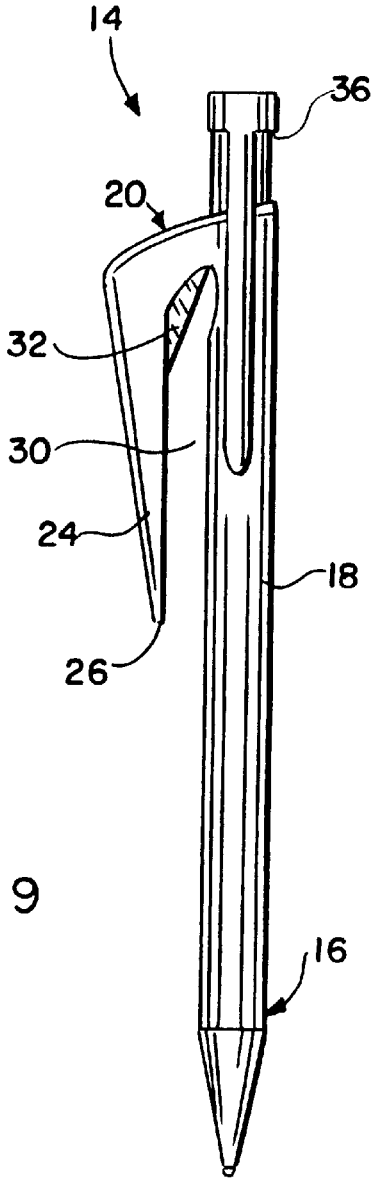
FIG. 9 is an elevational view of the combination writing instrument and letter opener of FIG. 8.

As shown in the drawings for purposes of illustration, the present invention is concerned with the combination of a letter opener and a writing instrument, which combination is generally referred to in FIGS. 1–4 by reference number 10, in FIGS. 5–7 by the reference number 12, and in FIGS. 8 and 9 by the reference number 14. The combinations 10–14 of a letter opener and writing instrument grant more convenience to a user, such as a secretary or receptionist, who periodically needs to utilize both a writing instrument and a letter opener at nearly the same time, as the invention replaces the need to operate and manage two separate devices.

In accordance with the invention, and with reference to FIGS. 1–4, the combination 10 is comprised of a writing instrument 16, which may be of any form including a pencil, marker or ink pen which has an elongated body 18, and a letter opener 20. The letter opener 20 generally comprises a frame 22 having a finger protrusion 24 extending and spaced apart from the frame 22 and tapered to a point 26. The frame 22 is typically a planar, one-piece member, but is not limited to a particular shape, width or size. The space between an inner edge 28 of the frame 22 and the finger protrusion 24 forms a paper accepting channel 30. A cutting element 32, preferably a triangular shaped metal razor blade, is positioned within the paper accepting channel 30. Fasteners 34 are attached to or integrally formed with the frame 22 of the letter opener 20 for releasably attaching the letter opener 20 to the writing instrument 16. The fasteners 34 may be in the form of coupling clips as illustrated in FIG. 4.

In use, the letter opener 20 is attached to the elongated body 18 of the writing instrument 16 by pressing the elongated body 18 into the fasteners 34 of the letter opener 20. To cut open an envelope, the tapered point 26 of the finger protrusion 24 is inserted into a small opening of a flap of the envelope. The finger protrusion 24 acts as a guide, feeding the flap of the envelope into the paper accepting channel 30 until the paper abuts the cutting element 32 where the flap is sliced open to reveal the contents of the envelope.

The embodiment of FIGS. 1–4 is particularly useful in that the letter opener 20 can be attached to a variety of writing instruments 16, so long as the elongated body 18 is fastenable to the letter opener 20. The fasteners 34 can be manufactured in varying sizes to fit different sized writing instruments, or can be manufactured in a manner that the fasteners 34 fit to a wide range of writing instruments.

The letter opener 20 may also be integrally incorporated onto or formed with the writing instrument 16 as illustrated in one embodiment in FIGS. 5–7 and in another in FIGS. 8 and 9. In these embodiments, the frame 22 of the letter opener 20 is permanently attached to, or preferably integrally formed or molded with, the elongated body 18 of the writing instrument 16. The writing instrument 16 may be of any form, but is illustrated in the form of an ink pen or a mechanical pencil having a retracting mechanism 36. The writing instrument 16 may also have a lid, pocket clip or any other similar attachments as the letter opener 20 can be formed at any position along the elongated body 18 while still allowing use of the writing instrument 16.

The finger protrusion 24 extends out from the body 18 of the writing instrument 16 and tapers to a point 26. The finger protrusion 24 is spaced apart from the body 18, forming a paper accepting channel 30 in which is positioned a cutting element 32 such as a metal razor blade, or any other element which has an edge sufficiently sharpened to cut paper. The body 18 of the writing instrument 16 may bulge and extend towards the finger protrusion 24 in order to form the paper accepting channel 30, as shown in FIGS. 5 and 6. Alternatively, the paper accepting channel 30 may be formed between the finger protrusion 24 and the standard body of the writing instrument 16, as illustrated in FIGS. 8 and 9.

In either form, the combination 12 and 14 of a writing instrument and letter opener operate by inserting the pointed tip 26 of the finger protrusion 24 into the flap of the letter and guiding the flap of the envelope through the paper accepting channel 30 to the cutting element 32, cutting the flap open and revealing the contents of the letter.

Although several embodiments of the invention have been described in detail for purposes of illustration, various modifications of each may be made without departing from the scope and spirit of the invention. Accordingly, the invention is not to be limited, except as by the appended claims.

What is claimed is:

1. A combination writing instrument and letter opener, comprising:

a writing instrument having an elongated body; and a letter opener coupled to the body of the writing instrument and including fasteners for attaching the frame to the writing instrument, and a frame having a finger protrusion tapering to an end extending therefrom and an inner edge of the frame and finger protrusion defining a paper accepting channel having a cutting element positioned therein.

2. The combination of claim 1, wherein the fasteners comprise coupling clips integrally formed on the frame, wherein the letter opener is removably attached to the writing instrument.

3. The combination of claim 1, wherein the elongated body includes a hump extending towards the finger protrusion and further defining the paper accepting channel.

4. The combination of claim 1, wherein the cutting element comprises a razor blade.

5. A combination writing instrument and letter opener, comprising:

a writing instrument having a body and a writing element within the body; and a letter opener including a frame having fasteners integrally formed thereon, a finger protrusion tapering to an end extending from the frame and an inner edge of the frame and finger protrusion defining a paper accepting channel having a metal cutting element positioned therein, the letter opener removably coupled to the writing instrument by way of attachment of the fasteners to the body of the writing instrument.

* * * * *